US007768477B2

(12) United States Patent
Jung et al.

(10) Patent No.: US 7,768,477 B2
(45) Date of Patent: Aug. 3, 2010

(54) PLASMA DISPLAY APPARATUS AND DRIVING METHOD OF THE SAME

(75) Inventors: Yun Kwon Jung, Gumi-si (KR); Gun Su Kim, Sungnam-si (KR)

(73) Assignee: LG Electronics Inc., Seoul (KR)

( * ) Notice: Subject to any disclaimer, the term of this patent is extended or adjusted under 35 U.S.C. 154(b) by 1141 days.

(21) Appl. No.: 11/406,231

(22) Filed: Apr. 19, 2006

(65) Prior Publication Data

US 2007/0069990 A1 Mar. 29, 2007

(30) Foreign Application Priority Data

Sep. 29, 2005 (KR) ..... 10-2005-0091433

(51) Int. Cl.
*G09G 3/28* (2006.01)

(52) U.S. Cl. ..... 345/60; 345/67; 315/169.1

(58) Field of Classification Search ..... 345/60–68; 315/169.1–169.4; 313/484, 585
See application file for complete search history.

(56) References Cited

U.S. PATENT DOCUMENTS

| | | | | |
|---|---|---|---|---|
| 6,175,192 | B1 | 1/2001 | Moon | 315/169.3 |
| RE37,083 | E * | 3/2001 | Kanazawa | 315/169.4 |
| 6,995,735 | B2 * | 2/2006 | Mizobata | 345/60 |
| 7,605,778 | B2 * | 10/2009 | Akiba | 345/60 |
| 2003/0085886 | A1 | 5/2003 | Ide et al. | 345/211 |
| 2003/0090441 | A1 * | 5/2003 | Kim et al. | 345/60 |
| 2004/0001035 | A1 * | 1/2004 | Awamoto et al. | 345/60 |
| 2008/0079664 | A1 * | 4/2008 | Ikeda et al. | 345/60 |

FOREIGN PATENT DOCUMENTS

| | | |
|---|---|---|
| EP | 1 339 038 A1 | 8/2003 |
| EP | 1 486 941 A2 | 12/2004 |
| JP | 2001-075528 | 3/2001 |
| WO | WO 00/14711 | 3/2000 |

OTHER PUBLICATIONS

European Search Report dated Jul. 30, 2007.

* cited by examiner

*Primary Examiner*—Kimnhung Nguyen
(74) *Attorney, Agent, or Firm*—KED & Associates, LLP

(57) ABSTRACT

In a plasma display apparatus and a method of driving the same which is driven by a driving signal having a reset period, an address period and a sustain period, a sustain pulse is applied during the sustain period, the sustain pulse including: an interval in which the sustain pulse rises from a ground voltage to a first voltage; an interval in which the first voltage is substantially constant for predetermined period of time; an interval in which the sustain pulse rises from the first voltage to a second voltage; and an interval in which the second voltage is substantially constant for a predetermined period of time. At least two discharges can be generated per a single sustain pulse by applying a sustain pulse rising and falling in two stages during one sustain period, and discharge efficiency and luminance can be improved by lengthening a light emission time by maintaining the light generated by a discharge for a predetermined time.

14 Claims, 12 Drawing Sheets

PLASMA DISPLAY APPARATUS AND DRIVING METHOD OF THE SAME

BACKGROUND OF THE INVENTION

1. Field of the Invention

The present invention relates to a plasma display apparatus and a method of driving the same, and more particularly, to a plasma display apparatus, which improves discharge efficiency by enhancing waveforms of sustain pulses applied during the sustain period of the plasma display apparatus, and a method of driving the same.

2. Background of the Related Art

A Plasma Display Panel (hereinafter PDP) is a device to display a picture through excitation and light emission of a phosphor by a vacuum ultraviolet (VUV) generated at the time of discharging an inert mixture gas. The PDP has advantages in that it can be large-sized and thin-filmed, its manufacture is easy due to a simple structure, and luminance and light emission efficiency are higher than those in other flat display devices. Especially, an alternate current surface discharge PDP has advantages of a low voltage operation and a long life since a wall charge is accumulated on a surface at the time of a discharge and the accumulated chargers protects the electrodes from sputtering generated by the discharge.

The plasma display panel is a display device which is obtained by coating several requisite layers over two sheets of flat glass basically forming an upper substrate and a lower substrate and thereafter bonding them each other.

On the upper substrate, a scan electrode for selecting a scan electrode line at the time of driving and a sustain electrode for delivering a sustain signal in order to cause a surface discharge along with a selected cell are mounted. On the upper end of the scan and sustain electrodes, a dielectric layer and a dielectric protective layer are sequentially formed.

On the lower substrate, an address electrode for delivering a data signal is formed, and on the upper end of the address electrode, a dielectric layer is formed. Barrier ribs for partitioning a discharge space are sequentially provided on the upper end of the formed dielectric layer.

A phosphor is coated over the discharge space, and the phosphor is excited by a vacuum ultraviolet (VUV) generated from an inert mixture gas filled in the discharge space to emit light.

The plasma display panel is driven by being divided into a reset period for initializing the entire cells, an address period for selecting cells and a sustain period for causing a display discharge in the selected cells.

That is, one frame period is divided into a plurality of subfields having a different number of emission according to a luminance weight. Each of the subfields is divided into a reset period, an address period and a sustain period.

The sustain discharge of the AC surface-discharge PDP driven in the above manner requires a high voltage. Accordingly, an energy recovering apparatus is used for recovering a-voltage between the scan electrode Y and the sustain electrode Z, to thereby use the recovered voltage as a driving voltage upon the next discharge.

FIG. 1 is a view showing a plasma display apparatus having an energy recovery circuit 10 and a square wave supply circuit 20 that are formed for recovering the sustain discharge voltage.

The energy recovery circuit 10 includes a source capacitor Cs, an inductor L, a first switch Q1 for supplying energy stored in the source capacitor to a panel capacitor PANEL, and a second switch Q2 for recovering the energy from the panel capacitor.

The square wave supply circuit 20 includes a third switch for applying a sustain voltage to the panel capacitor and a fourth switch Q4 for dropping a voltage of the panel capacitor to a ground voltage.

Here, the panel capacitor equivalently denotes electrostatic capacitance formed between the scan electrode Y and the sustain electrode Z.

FIG. 2 is a waveform and timing diagram showing output waveforms of the plasma display apparatus as illustrated in FIG. 1.

Referring to FIG. 2, the first switch Q1 is turned on, thereby applying the energy stored in the source capacitor Cs to the panel capacitor and increasing the voltage, and the third switch is turned on, thereby maintaining the sustain voltage, whereupon a sustain discharge occurs.

Accordingly, when a sustain pulse of a square waveform is supplied, only one discharge occurs for a short time during the initial period of the sustain pulse. The amount of light generated in the discharge is proportional to the discharge time. By this, the conventional plasma display apparatus applied with a square wave during the sustain period has a disadvantage of having a low light emission efficiency because light emission occurs for a short time.

SUMMARY OF THE INVENTION

Accordingly, the present invention is directed to solve the conventional problems, and has for its object to provide a plasma display apparatus, which allows a discharge to occur once or more by one sustain pulse and improves luminance and discharge efficiency by increasing a discharge sustain time.

There is provided a plasma display apparatus in accordance with the present invention, including: a first electrode formed on an upper substrate; and a first electrode driver for applying a driving signal to the first electrode, wherein the first electrode driver applies a sustain pulse during a sustain period, the sustain pulse including: an interval in which the sustain pulse rises from a ground voltage to a first voltage; an interval in which the first voltage is substantially constant for predetermined period of time; an interval in which the sustain pulse rises from the first voltage to a second voltage; and an interval in which the second voltage is substantially constant for a predetermined period of time.

There is provided a method of driving a plasma display apparatus which is driven by a driving signal having a reset period, an address period and a sustain period in accordance with the present invention, wherein a sustain pulse is applied during the sustain period, the sustain pulse including: an interval in which the sustain pulse rises from a ground voltage to a first voltage; an interval in which the first voltage is substantially constant for predetermined period of time; an interval in which the sustain pulse rises from the first voltage to a second voltage; and an interval in which the second voltage is substantially constant for a predetermined period of time.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Hereinafter, preferred embodiments of the present invention will be described in detail with reference to the accompanying drawings.

Figure 3:
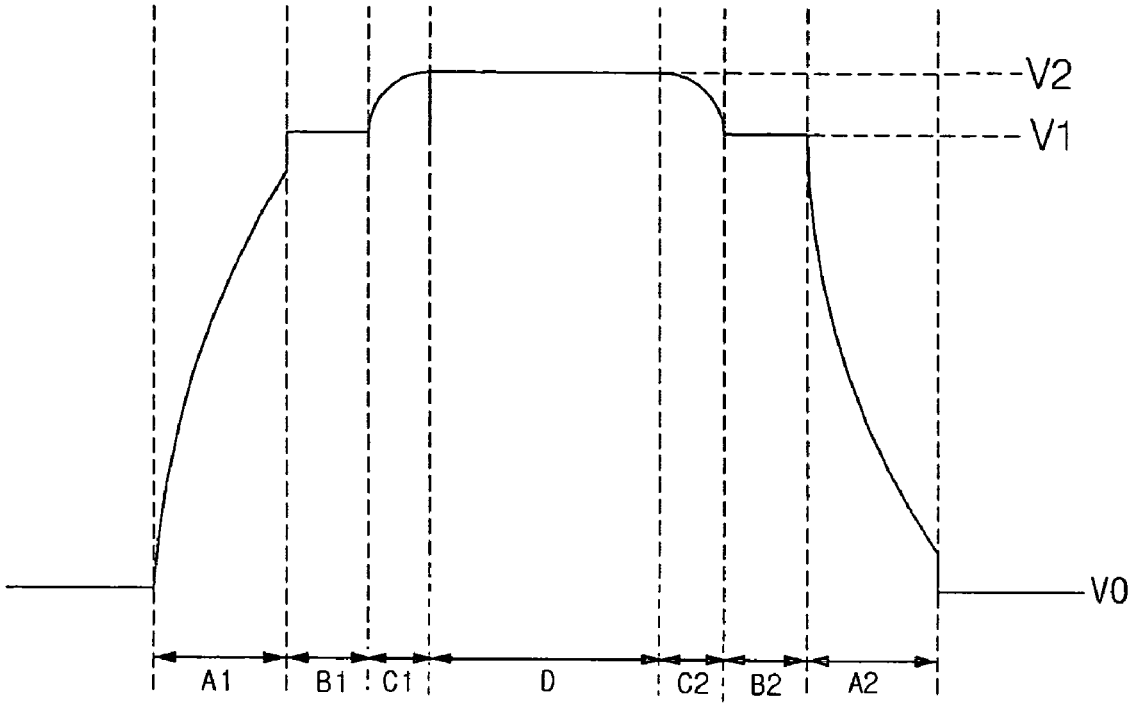
FIG. 3 is a view illustrating a driving waveform of a first embodiment of a plasma display apparatus in accordance with the present invention.
Figure 4:
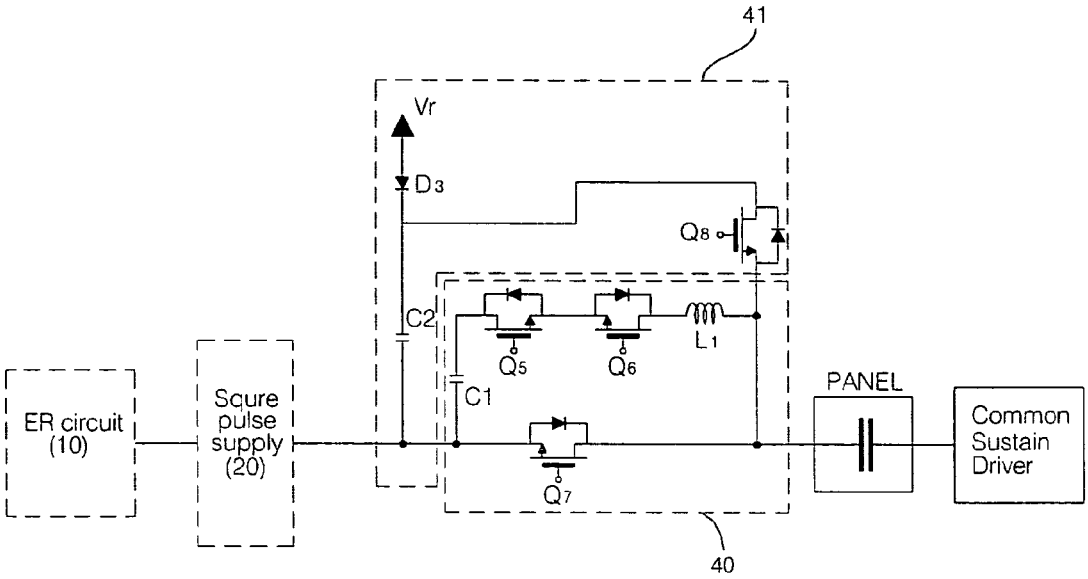
FIG. 4 is a circuit diagram illustrating the first embodiment of the plasma display apparatus in accordance with the present invention.
Figure 5:
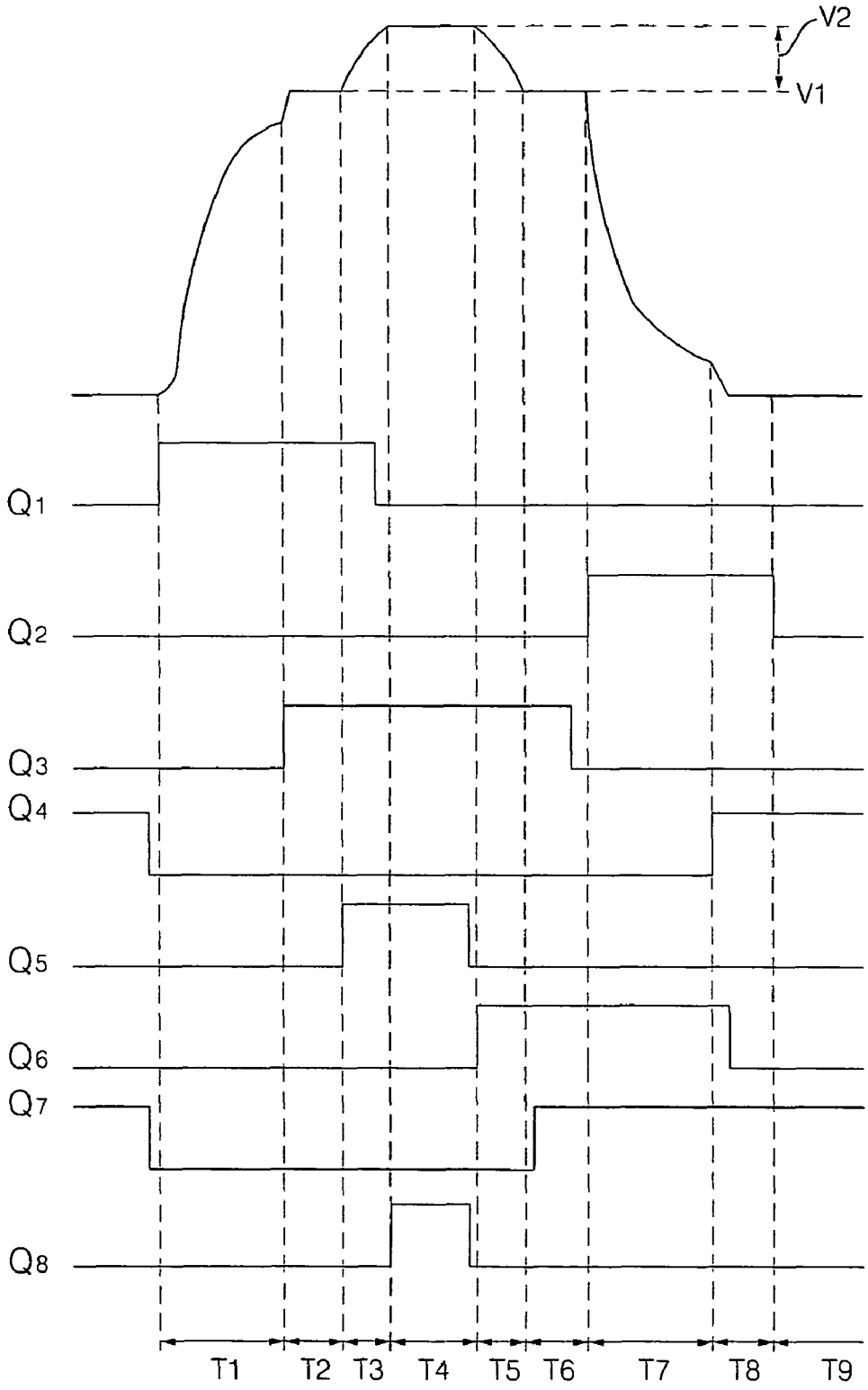
FIG. 5 is a view illustrating a circuit output waveform and timing of the first embodiment in accordance with the present invention.
Figure 6:
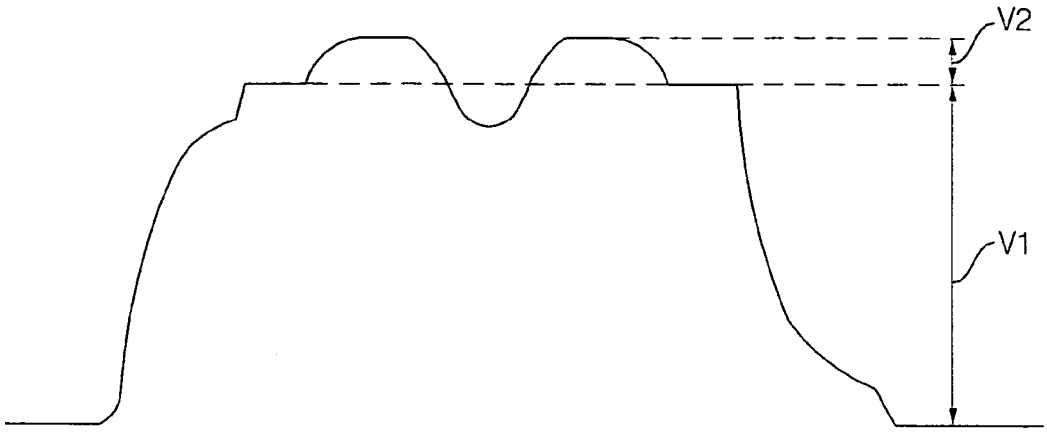
FIG. 6 is a view illustrating a modified example of the circuit output waveform of the first embodiment in accordance with the present invention.

FIG. 3 is a view illustrating a driving waveform of a first embodiment of a plasma display apparatus in accordance with the present invention. FIG. 4 is a circuit diagram illustrating the first embodiment of the plasma display apparatus in accordance with the present invention. FIG. 5 is a view illustrating a circuit output waveform and timing of the first embodiment in accordance with the present invention. FIG. 6 is a view illustrating a modified example of the circuit output waveform of the first embodiment in accordance with the present invention.

The plasma display apparatus in accordance with the present invention includes: a first electrode formed on an upper substrate; and a first electrode driver for applying a driving signal to the first electrode, wherein the first electrode driver applies a sustain pulse during a sustain period, the sustain pulse including: an interval in which the sustain pulse rises from a ground voltage to a first voltage; an interval in which the first voltage is substantially constant for predetermined period of time; an interval in which the sustain pulse rises from the first voltage to a second voltage; and an interval in which the second voltage is substantially constant for a predetermined period of time.

Here, the first electrode is a scan electrode or sustain electrode. A sustain pulse is alternately applied to the scan electrode or sustain electrode during the sustain period. The sustain pulse has such a waveform in which it rises/falls in two stages.

Specifically, the sustain pulse has a form as shown in FIG. 3. Referring to FIG. 3, an output signal of a first electrode driver rises from a ground voltage V0 to a first voltage V1 (A1).

At this point, the first voltage V1 is less than a discharge start voltage. Therefore, in a case where the voltage right before the discharge start voltage rises up to the first voltage, no discharge occurs. Such a rise of the voltage in the interval A1 can be achieved by an energy recovery circuit provided at the first electrode driver.

Next, the first voltage is substantially constant for a predetermined period of time (B1).

After the first voltage is kept constant for a short time, an output of the first electrode driver rises from the first voltage V1 to the second voltage V2 (C1). At this time, the second voltage has a voltage value higher than the discharge start voltage. In the interval in which the sustain pulse rises from the first voltage to the second voltage, the voltage gradually increases with a predetermined curvature. Such a rise of the voltage in the interval C1 can be obtained by using a resonant wave generated by resonation with the panel capacitor and the inductor provided at the first electrode driver. That is, the first voltage can be raised up to the second voltage by using the increment of the resonant waveform. During the rise from the first voltage to the second voltage, a sustain discharge occurs.

Next, the second voltage V2 is substantially constant during a predetermined period of time (D). One more sustain discharge can occur while the second voltage is kept constant during a predetermined period of time. And, by sustaining the second voltage, which is higher than a sustain discharge voltage, the light generated by the sustain discharge can be sustained for a longer time. By this, the luminance is improved.

After the second voltage V2 is kept constant for a predetermined period of time, the voltage decreases from the second voltage V2 to the first voltage again (C2). Afterwards, the first voltage V1 is kept constant again for a short time (B2), and the voltage decreases from the first voltage to the ground voltage V0 again (A2).

All of the intervals from A1 to A2 are provided during one sustain pulse, and such a sustain pulse is repetitively applied during a sustain period.

That is, by making two or more sustain charges occur by one sustain pulse, the discharge efficiency can be improved.

A circuit for generating such a sustain pulse is illustrated in FIG. 4.

Figure 1:
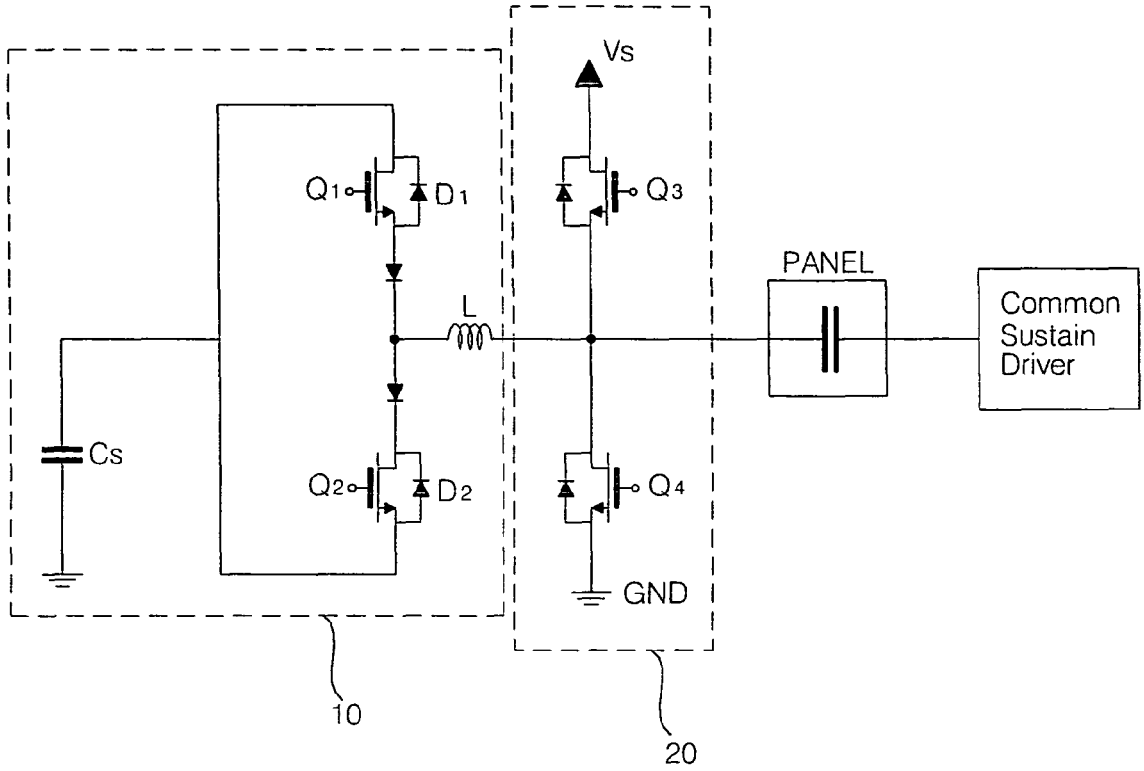
Fig.1 (related art)
FIG. 1 is a view showing an energy recovery circuit and a square wave supply circuit of a conventional plasma display apparatus.
Figure 2:
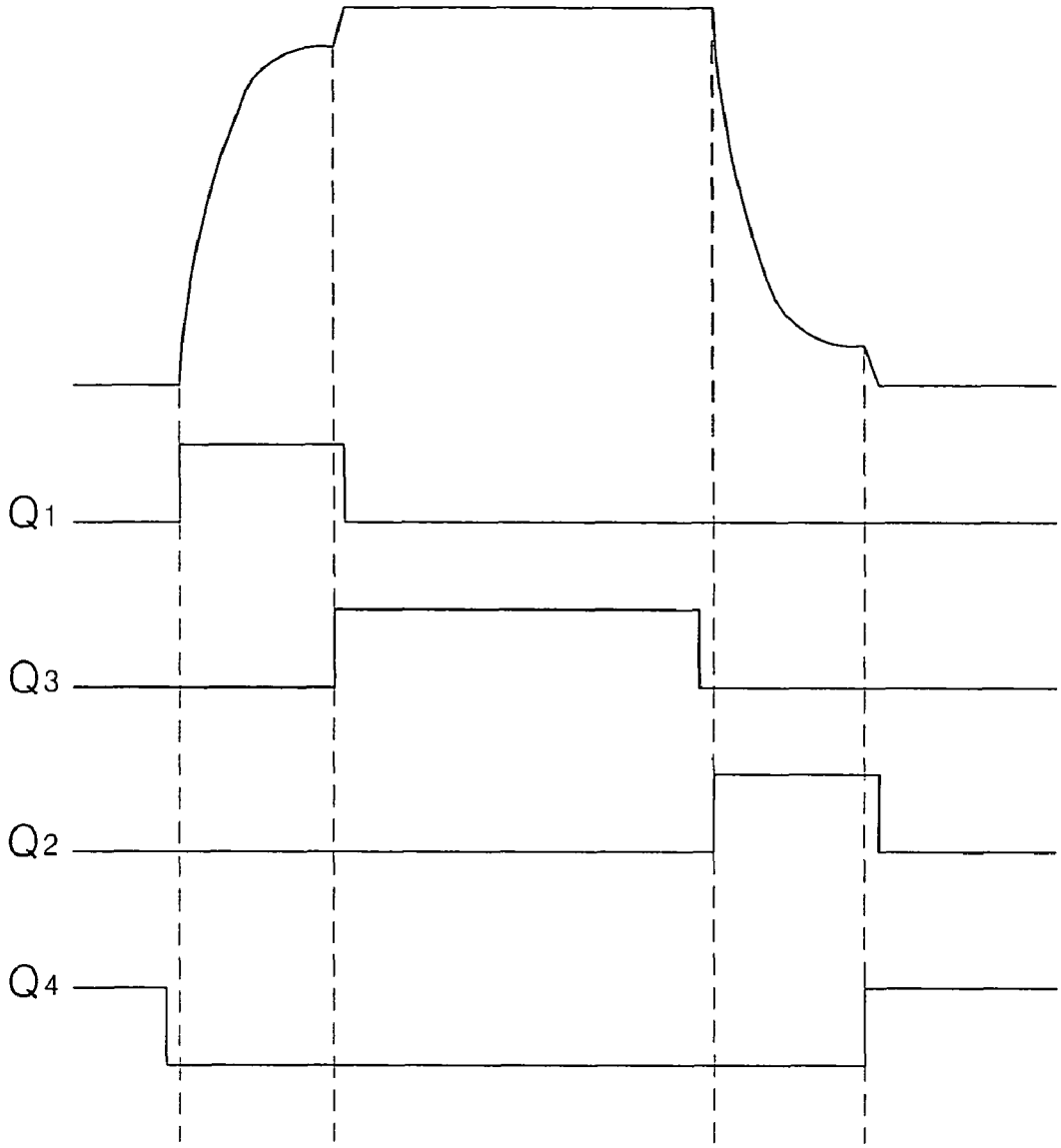
Fig.2 (related art)
FIG. 2 is a view illustrating parts of a sustain waveform of the conventional plasma display apparatus.

Referring to FIG. 4, the first electrode driver includes an energy recovery circuit 10, a square wave supply circuit 20, a sine wave supply circuit 30 and a smoothing circuit 41. Here, the configuration of the energy recovery circuit 10 and of the square wave supply circuit 20 is substantially the same as that of FIG. 1.

In the present invention, the plasma display panel is referred to as a panel capacitor having an equivalent capacitance for the convenience of explanation.

The energy recovery circuit 10 is provided with a source capacitor Cs and a plurality of switches and inductors.

At this time, the source capacitor Cs recovers the voltage charged to the panel capacitor during a sustain discharge, is charged with the recovered voltage, and then re-supplies the charged voltage to the panel capacitor. To this end, the source capacitor Cs has a capacitance capable of charging the voltage of ½ that corresponds to a half of the first voltage V1.

The energy recovery circuit 10 includes a second inductor L2 connected between the panel capacitor and the source capacitor Cs, for forming a resonant circuit together with the panel capacitor and first and second switches Q1 and Q2 connected in parallel between the source capacitor Cs and the second inductor L2.

The first switch Q1 forms a charge path for applying a voltage charged in the source capacitor to the panel capacitor, and the second switch Q2 forms a recovery path for recovering a voltage charged in the panel capacitor into the source capacitor.

The square wave supply circuit 20 alternately applies the first voltage V1 and the ground voltage during the sustain period to generate a pulse-shaped waveform.

The square wave supply circuit 20 is formed between the second inductor L2 and the panel capacitor, and includes a first voltage source Vs1, a third switch Q3 connected to the first voltage source Vs1 and a fourth switch Q4 connected to a ground voltage source GND.

Here, a voltage value V1 of the first voltage source Vs1 is a voltage lower than the voltage at which the sustain discharge occurs.

The third switch Q3 operates in a manner that the panel capacitor is charged with a voltage by the energy recovery circuit and conducted to apply the first voltage V1 to the panel capacitor.

The fourth switch Q4 operates in a manner that the voltage is recovered from the panel capacitor by the energy recovery circuit and conducted to drop the voltage of the panel capacitor to the ground voltage.

The sine wave supply circuit 40 overlaps and applies sine waves during the period when the first voltage is applied by the square wave supply circuit 20. This sine wave supply circuit refers to a circuit that allows a curved voltage as well as a sine wave to fall regardless of the name.

The sine wave supply circuit 40 includes a first capacitor C1 charged with a half of the second voltage and a first inductor L1.

Furthermore, the sine wave supply circuit 40 includes fifth and sixth switches Q5 and Q6 formed between one end of the first capacitor C1 and the inductor L1 and a seventh switch Q7 formed between the other end of the first capacitor and the panel capacitor.

The first inductor L1 allows a sine wave to be supplied to the panel capacitor while resonating with the panel capacitor when a predetermined voltage is supplied to the first capacitor from the first capacitor C1. The fifth and sixth switches Q5 and 6 and the seventh switch Q7 are turned on and off at predetermined times to control a current flow.

The smoothing circuit 41 is mounted so as to be connected to the square wave supply circuit 20 and the sine wave supply circuit 40. This smoothing circuit 41 includes a second voltage source Vr, a second capacitor C2 charged with energy from the second voltage source and an eighth switch Q8 forming a current path for supplying a voltage to the panel capacitor. At this time, the capacitance of the second capacitor is set higher than the capacitance of the first capacitor C1, thus making it possible to charge a higher voltage.

The smoothing circuit 41 operates in a manner that if a sine wave reaches its peak, that is, the highest potential, the highest potential is maintained for a predetermined period of time.

In other words, the sine wave supply circuit 40 supplies a sine wave, and when the level of the sine wave reaches its peak, the eighth switch Q8 is turned on to supply the voltage Vr charged in the second capacitor to the panel capacitor, thereby coming into a holding state.

The second voltage source Vr is connected to a diode D3, and prevents a current from flowing back from the panel capacitor toward the voltage source.

Referring to FIG. 5, the circuit output waveform of the first electrode driver and the operation timing of the switches will be explained.

During a period T1, the first switch Q1 is turned on to form a current path from the source capacitor Cs to the panel capacitor Cp via the first switch Q1 and the second inductor L2. Once the current path is formed, the voltage Vs1/2 charged in the source capacitor Cs is supplied to the panel capacitor PANEL. In doing so, since the second inductor L2 and panel capacitor PANEL construct a serial resonant circuit, a voltage of Vs1, substantially twice the voltage of the source capacitor Cs, is supplied to the panel capacitor PANEL.

During a period T2, the third switch Q3 is turned on to supply a first voltage to the panel capacitor, and thus the voltage of the panel capacitor is maintained at the first voltage V1. Meanwhile, since the first voltage V1 is a voltage at which a sustain discharge substantially starts, it is set to be lower than a conventional sustain voltage Vs, so that a sum of wall charges formed at the panel capacitor Cp with the first voltage V1 fails to go beyond a discharge start voltage. Thus, during the period T2, a sustain discharge is not generated at the panel capacitor.

During a period T3, the fifth switch Q5 is turned on. If the fifth switch is turned on, then a voltage Vr/2 charged at the first capacitor C1 is applied, via the fifth switch Q5, the sixth switch Q6 and the first inductor L1, to the panel capacitor. At this time, since the first inductor L1 forms a serial resonant circuit along with the panel capacitor PANEL, a sine wave having a voltage level of a second voltage V2 is supplied to the panel capacitor PANEL. Here, the panel capacitor supplied with a voltage higher than the first voltage by the sine wave has a voltage value higher than the discharge start voltage, and accordingly a sustain discharge is generated at the panel capacitor.

During a period T4, the eighth switch Q8 is turned on. When the sine wave reaches its peak, if the eighth switch Q8 is turned on, a second voltage V2 having a voltage level of Vr is supplied from the second capacitor C2, via the eighth switch Q8, to the panel capacitor. Thus, during the period T4, the panel capacitor comes into a holding state at which the second voltage level is maintained.

During a period T5, the sixth switch Q6 is turned on and the fifth switch Q5 is turned off to form a current path from the panel capacitor to the first capacitor C1 via the fifth and sixth switches Q5 and Q6, thereby recovering the voltage from the panel capacitor. At this time, the voltage charged at the first capacitor is VR/2 that substantially corresponds to a half of V2.

During a period T6 and a period T7, the seventh switch Q7 and the second switch Q2 are turned on. Thus, there is formed a current path for recovering energy from the panel capacitor, via the seventh switch Q7 and the second switch Q2 of the square wave supply circuit 20, to the source capacitor of the energy recovery circuit 10, thereby recovering the voltage.

During a period 8, the fourth switch Q4 is turned on to drop the voltage of the panel capacitor to the ground voltage, and during a period T9, the second switch Q2 is turned off to maintain the ground voltage. Substantially, the pulses supplied to the scan and sustain electrodes in the present invention can be provided by repeating the periods T1 to T9 periodically. The first embodiment of the present invention constructed and operated as described above is configured such that the sine wave appears on a square waveform for at least a ½ period or longer.

Even after the discharge occurs at the point of time when the sine wave rises, a voltage higher than the discharge start voltage is continuously applied, which allows the discharge to be sustained, thereby improving the light emission efficiency. That is to say, by maintaining the highest potential of the sine wave for a predetermined period of time, the discharge can be sustained for a longer time. Thus, the generated light is also sustained longer.

FIG. 6 is a view illustrating a state in which the sine wave is applied during one period or more so that two or more peak portions having the highest potential can appear on a square waveform. That is, two or more flat portions of the highest potential are maintained.

In this case, if two or more peak portions of the sine wave are applied, several times of discharge occurs during one sustain pulse period. Thus, the light emission efficiency becomes higher as compared to when one discharge occurs to one sustain pulse in the conventional art.

Moreover, in this case, also, the highest potential is maintained for a predetermined period of time, which lengthens a light emission time and improves light emission efficiency.

Figure 7:
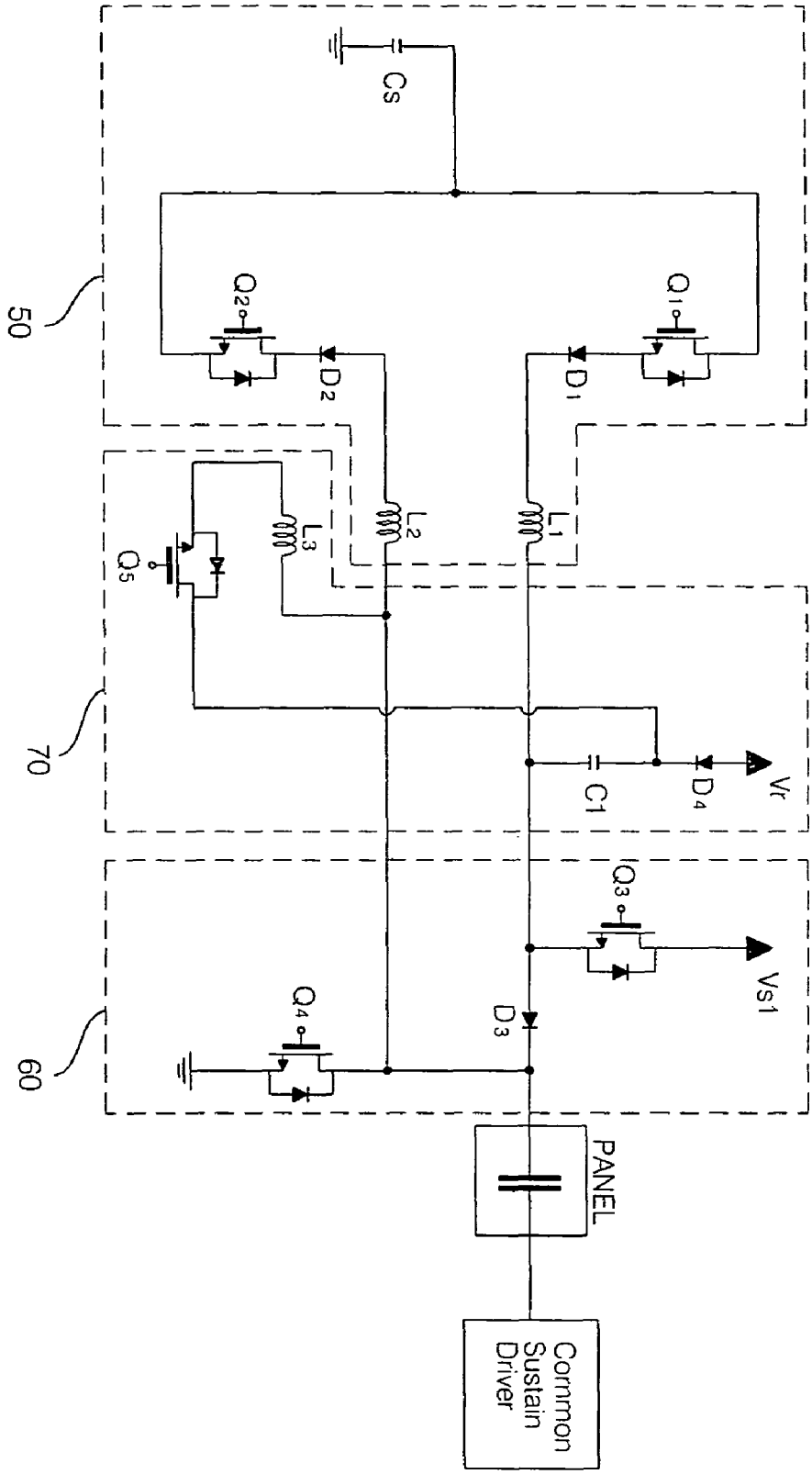
FIG. 7 is a circuit diagram illustrating a second embodiment of the plasma display apparatus in accordance with the present invention.
Figure 8:
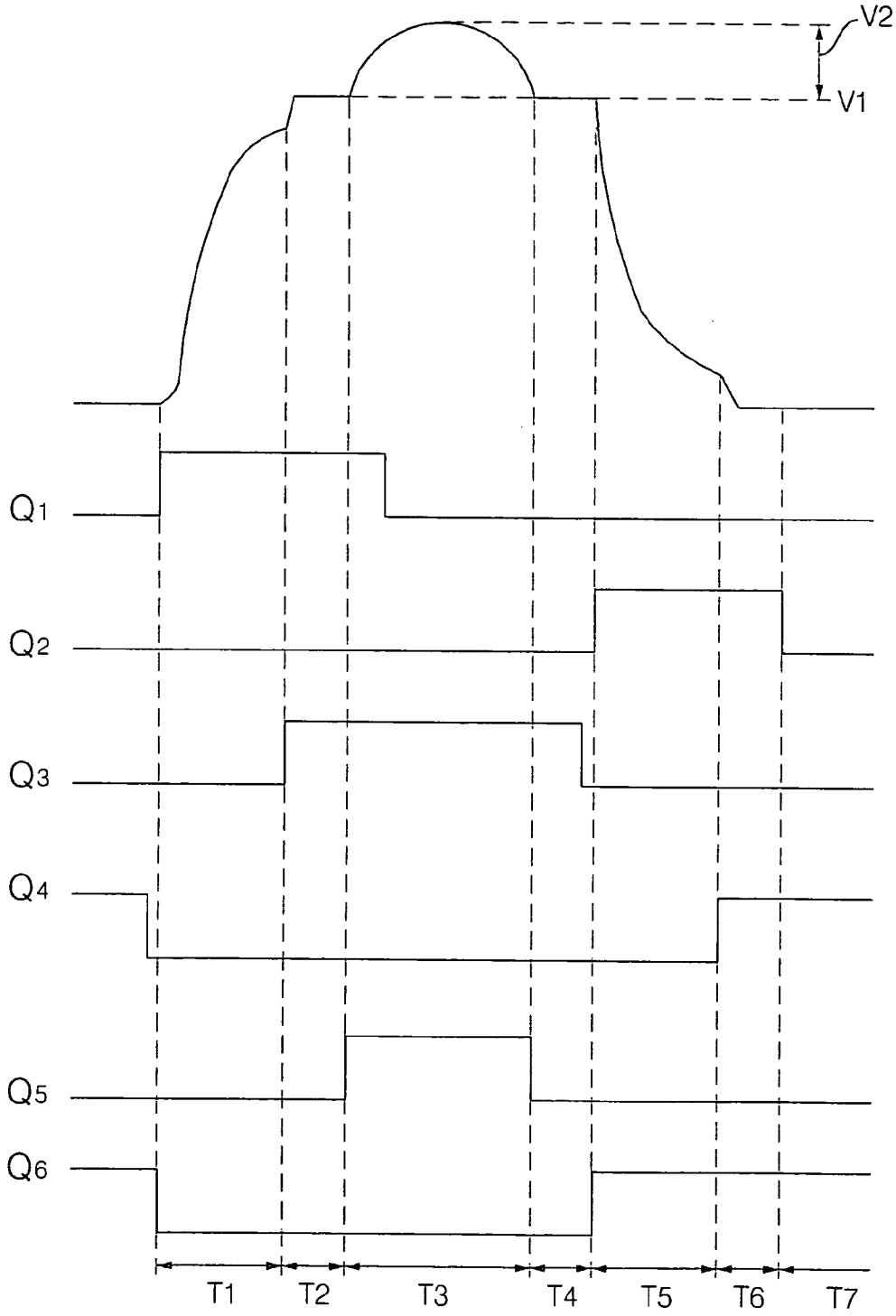
FIG. 8 is a view illustrating a circuit output waveform and timing of the second embodiment in accordance with the present invention.
Figure 9:
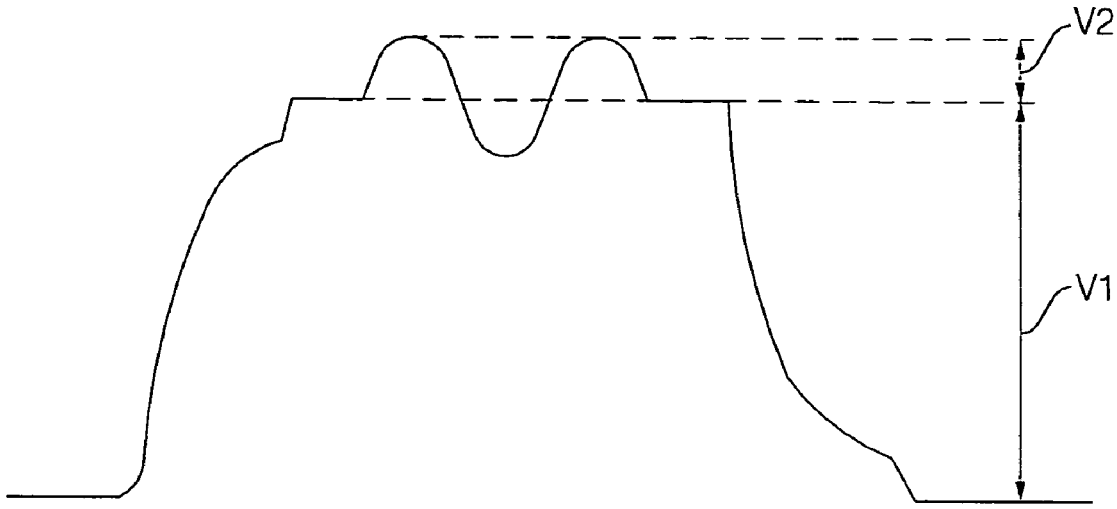
FIG. 9 is a view illustrating a modified example of the circuit output waveform of the second embodiment in accordance with the present invention.

FIG. 7 is a circuit diagram illustrating a second embodiment of the plasma display apparatus in accordance with the present invention. FIG. 8 is a view illustrating a circuit output waveform and timing of the second embodiment in accordance with the present invention. FIG. 9 is a view illustrating a modified example of the circuit output waveform of the second embodiment in accordance with the present invention.

The plasma display apparatus in accordance with the second embodiment of the present invention will be described with reference to FIG. 7. A first electrode driver includes an energy recovery circuit 50 for supplying and recovering energy, a square wave supply circuit 60 for supplying a square wave and a sine wave supply circuit 70 for supplying a sine wave.

The energy recovery circuit 50 is divided into a charge path a for applying energy from the source capacitor to the panel capacitor and a recovery path b for recovering the energy. The charge path a is provided with a first inductor L1 connected between the source capacitor Cs and the panel capacitor, a first switch Q1 and a diode, and the recovery path b is provided with a second inductor L2 connected between the panel capacitor and the source capacitor Cs, a second switch Q2 and a diode. The first inductor L1 and the second inductor L2 form a resonant circuit along with the panel capacitor, and the inductance of L2 is the same as or higher than the inductance of L1.

The square wave supply circuit 60 is connected between the panel capacitor and the sine wave supply circuit 70, and is provided with a first voltage source Vs1 connected in parallel between the second inductor L2 and the panel capacitor, for supplying a first voltage, a third switch Q3 connected to the first voltage source Vs1 and a fourth switch Q4 connected to a ground voltage source GND.

Here, a voltage value V1 of the first voltage source Vs1 is set to be lower than a voltage value Vs of a conventional sustain voltage source. Thus, even though the voltage value of the first voltage source Vs1 is applied to a discharge cell at which an address discharge is generated, a voltage value of the discharge cell is set to be less than a discharge start voltage to thereby prevent a generation of sustain discharge. Moreover, a diode D3 is provided between the third switch Q3 and the panel capacitor to prevent a backward current from flowing to the charge path a.

The sine wave supply circuit includes a second voltage source for supplying a second voltage, a first capacitor charged with the second voltage, a third inductor L3 for converting the voltage charged in the first capacitor C1 into a sine wave by resonating with the panel capacitor to apply it, and at least one switch connected between the first capacitor and the third inductor.

Further, the sine wave supply circuit 70 is mounted between the energy recovery circuit 50 and the square wave supply unit 60, and is provided with a fifth switch Q5 which is turned on so as to form a current path from the first capacitor C1, via the third inductor L3, to the panel capacitor. Besides, a diode D4 is provided between the second voltage source Vr and the first capacitor C1 to prevent a backward current flowing toward the voltage source.

The first capacitor C1 is charged with energy from the second voltage source Vr.

Here, a voltage of the second voltage source Vr is set to be lower than a voltage value of the first voltage source Vs1. Further, when the fifth switch Q5 is turned on, the first capacitor C1 supplies a charged voltage Vr to the third inductor L3, and supplies a sine wave having a second voltage V2 to the third inductor L3 and the panel capacitor having the serial resonant circuit formed therein.

The inductance of the third inductor L3 is set to be higher than the inductance of the first inductor L1 or of the second inductor L2.

The second voltage V2 is set to be lower than the first voltage V1, and a sum of the first voltage and the second voltage is set to be higher than a discharge start voltage. Further, the first voltage V1 is set to be less than the discharge start voltage, and substantially the same as the first voltage V1.

In the second embodiment constructed as above, the energy recovery circuit is divided into the charge path and the recovery path having a first inductor and a second inductor, respectively, and the sine wave supply circuit connected to the third inductor reduces the number of switching elements as compared to the first embodiment, thereby decreasing the manufacture cost.

Moreover, as a sine wave is applied to overlaps on the square wave, a discharge occurs at the point of time when the sine wave rises. Even after the discharge, a voltage higher than the discharge start voltage is applied up to the peak of the sine wave, thereby maintaining the discharge for a predetermined period of time. Thus, the light emission time is lengthened to improve the light emission efficiency.

Referring to FIG. 8 illustrating a circuit output waveform and timing diagram of the second embodiment in accordance with the present invention, the operating procedure will be described. During a period T1, the first switch Q1 is turned on to form a charge path from the source capacitor Cs to the panel capacitor via the first switch Q1 and the first inductor L1. Once the charge path is formed, the voltage Vs1/2 charged in the source capacitor Cs is supplied to the panel capacitor. At this time, a voltage of Vs1, substantially twice the voltage of the source capacitor Cs, is supplied to the first inductor L1 and the panel capacitor.

During a period T2, the third switch Q3 is turned on. Once the third switch Q3 is turned on, a first voltage is maintained. Further, during the period T2, a sustain discharge is not generated.

During a period T3, the fifth switch Q5 is turned on. Once the fifth switch Q5 is turned on, a current path is formed from the first capacitor charged with a voltage value of the second voltage source Vr to the panel capacitor via the third inductor L3 to supply a sine wave to the panel capacitor. At this time, since the third inductor L3 forms a serial resonant circuit along with the panel capacitor, a sine wave having a second voltage, which substantially corresponds to a voltage level of 2Vr, is supplied to the panel capacitor.

That is, a sine wave rising and falling from the first voltage to the second voltage is supplied to the panel capacitor, and a sustain discharge is generated at a discharge cell of the panel capacitor supplied with the sine wave having a level higher than a discharge start voltage.

During a period 4, the fifth switch Q5 is turned of to supply no sine wave to the panel capacitor, thereby maintaining the first voltage V1 again. That is, a voltage of the second voltage source Vr is charged from the panel capacitor to the first capacitor via the third inductor L3.

During a period 5, the second switch Q2 is turned on, and the third switch is turned off. Once the second switch Q2 is turned on, a recovery path b is formed from the panel capacitor to the source capacitor Cs via the second inductor L2 and the second switch, for recovering the voltage charged in the panel capacitor to the source capacitor Cs. At this time, a voltage of Vs1/2 is charged at the source capacitor Cs.

During a period T6, the fourth switch Q4 is turned on. Once the fourth switch Q4 is turned on, a current path is formed between the panel capacitor and the ground voltage source, thereby dropping the voltage of the panel capacitor to the ground voltage. During a period T7, the second switch Q2 is turned off, thereby maintaining the ground voltage.

In the output waveform of the second embodiment in accordance with the present invention, the energy is recovered via the second inductor L2 on the recovery path b. Thus, the output waveform curve of the period T5 is slower than the corresponding portion of the first embodiment.

The second embodiment of the present invention constructed and operated as described above is configured such that the sine wave appears on a square waveform for at least a ½ period or longer.

FIG. 9 is a view illustrating a state in which the sine wave is applied during one period or more so that two or more peak portions having the highest potential can appear on a square waveform.

If two or more peak portions of the sine wave are applied, two discharges occur during a single sustain pulse period. In this case, two or more peak portions have to be applied during one sustain pulse period. Thus, the period of the sine wave must be shorter than the case where one peak portion is applied.

Due to this, the discharge efficiency is improved as compared to the case where one discharge occurs during one sustain pulse in the conventional art.

Figure 10:
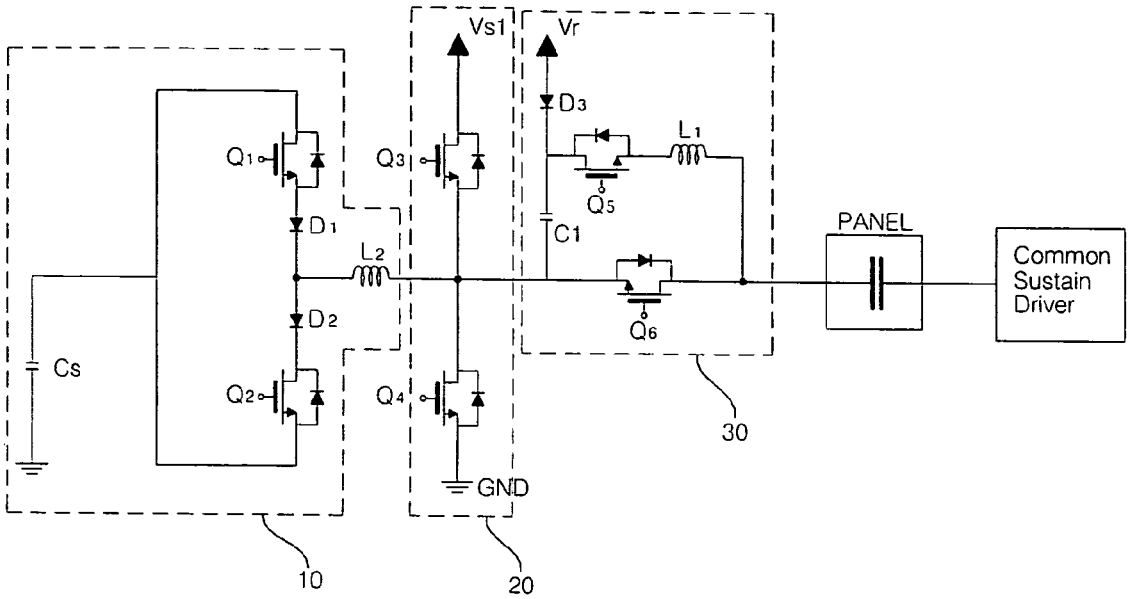
FIG. 10 is a circuit diagram illustrating a third embodiment of the plasma display apparatus in accordance with the present invention.
Figure 11:
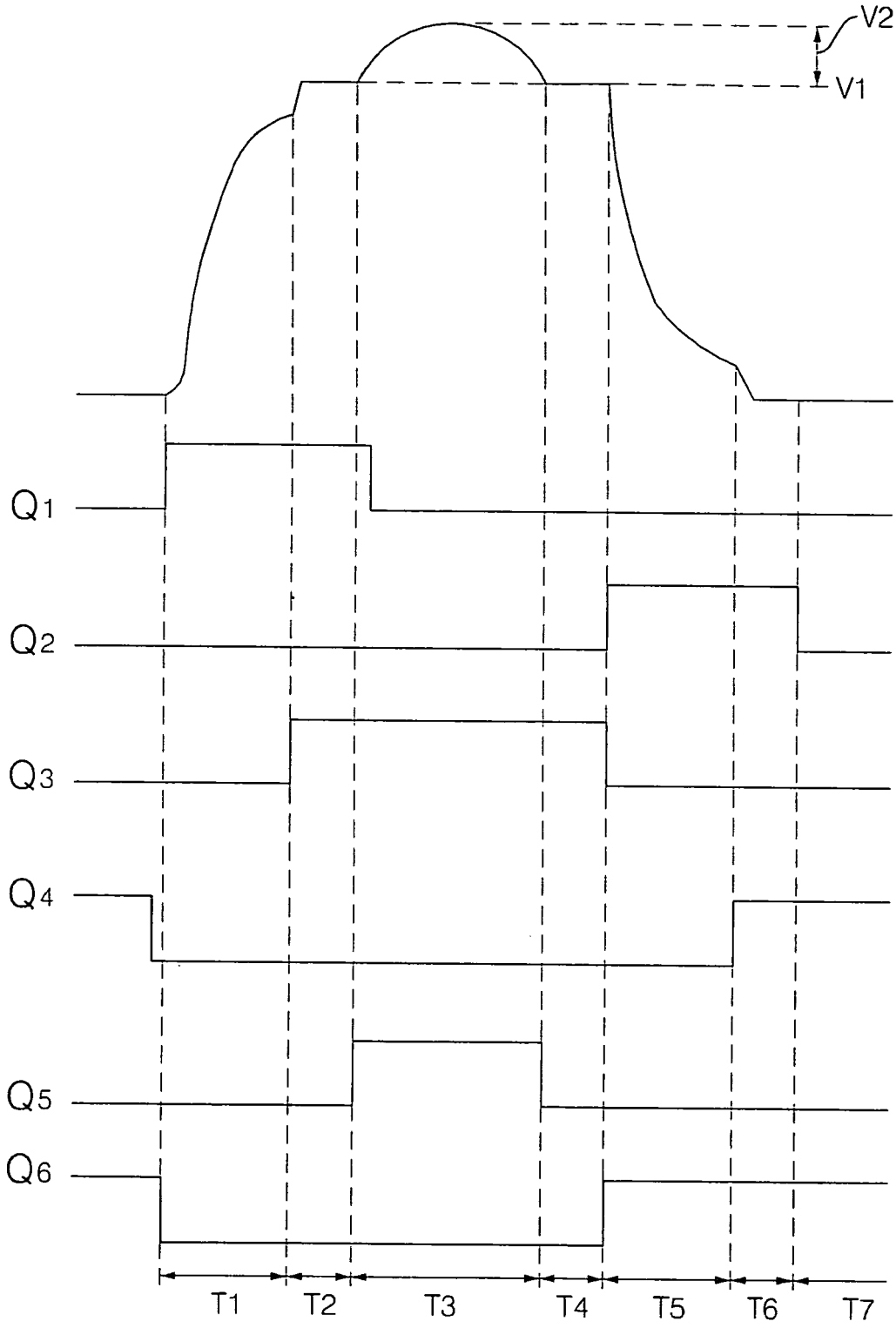
FIG. 11 is a view illustrating a circuit output waveform and timing of the third embodiment in accordance with the present invention.

FIG. 10 is a circuit diagram illustrating a third embodiment of the plasma display apparatus in accordance with the present invention. FIG. 11 is a view illustrating a circuit output waveform and timing of the third embodiment in accordance with the present invention.

Referring to FIG. 10, the plasma display apparatus in accordance with the third embodiment of the present invention includes an energy recovery circuit 10 for recovering and supplying energy, a square wave supply circuit 20 for supplying a square wave having a first voltage V1, and a sine wave supply circuit 30 for supplying a sine wave.

The energy recovery circuit and the square wave supply circuit supply a square wave rising up to the first voltage during a sustain period. The sine wave supply circuit supplies a sine wave that overlaps with the square wave and rises up to a second voltage. Here, the sine wave is shown on the first voltage which is the highest voltage of the square wave.

The energy recovery circuit 10 is provided with a source capacitor Cs and a plurality of switches and inductors.

At this time, the source capacitor Cs recovers the voltage charged to the panel capacitor during a sustain discharge, is charged with the recovered voltage, and then re-supplies the charged voltage to the panel capacitor. To this end, the source capacitor Cs has a capacitance capable of charging the voltage of ½ that corresponds to a half of the first voltage V1.

The energy recovery circuit 10 includes a second inductor L2 connected between the panel capacitor and the source capacitor Cs, for forming a resonant circuit together with the panel capacitor and first and second switches Q1 and Q2 connected in parallel between the source capacitor Cs and the second inductor L2.

The first switch Q1 forms a charge path for applying a voltage charged in the source capacitor to the panel capacitor, and the second switch Q2 forms a recovery path for recovering a voltage charged in the panel capacitor into the source capacitor.

The square wave supply circuit 20 alternately applies the first voltage V1 and the ground voltage during the sustain period to generate a pulse-shaped waveform.

The square wave supply circuit 20 is formed between the second inductor L2 and the panel capacitor, and includes a first voltage source Vs1, a third switch Q3 connected to the first voltage source Vs1 and a fourth switch Q4 connected to a ground voltage source GND.

Here, a voltage value V1 of the first voltage source Vs1 is a voltage lower than the voltage at which the sustain discharge occurs.

The third switch Q3 operates in a manner that the panel capacitor is charged with a voltage by the energy recovery circuit and conducted to apply the first voltage V1 to the panel capacitor.

The fourth switch Q4 operates in a manner that the voltage is recovered from the panel capacitor by the energy recovery circuit and conducted to drop the voltage of the panel capacitor to the ground voltage.

The sine wave supply circuit 30 is mounted so as to be connected to the square wave supply circuit 20 and the panel capacitor. This sine wave supply circuit includes a second voltage source Vr that corresponds to a half of the second voltage V2 so as to supply a sine wave rising from the first voltage to the second voltage and at least one capacitor and at least one inductor.

The second voltage source Vr supplies energy to the first capacitor C1. At this time, a voltage value of the second voltage is substantially a half of the second voltage, and the second voltage is set to be lower than the first voltage.

The first capacitor C1 is mounted so as to be connected between the second voltage source Vr and the square wave supply circuit 20, and is charge with energy of the second voltage source Vr and then supplies the energy to the first inductor L1 when the fifth switch Q5 is turned on.

The first inductor L1 forms a serial resonant circuit along with the panel capacitor. That is, the first inductor L1 allows a sine wave to be supplied to the panel capacitor while resonating with the panel capacitor.

Here, the inductance of the first inductor L1 is set to be higher than the inductance of the second inductor L2 so that a sine wave having a small slope can be supplied.

The fifth switch Q5 is turned on when a voltage of the panel capacitor reaches the first voltage by the square wave, and thus a sine wave is generated by resonation between the voltage charged in the first capacitor C1 and the second inductor L2.

The maximum voltage of the sine wave outputted at this time, i.e., the second voltage, is twice the voltage charged in the first capacitor. That is, the second voltage is twice the output voltage of the second voltage source.

The sixth switch Q6 is turned on after a sine wave is applied, and allows the voltage of the panel capacitor to fall from the first voltage to the ground voltage.

And, a diode is connected to the second voltage source to prevent a backward current flowing toward the voltage source from the panel capacitor.

FIG. 11 is a view illustrating a circuit output waveform and timing of the third embodiment in accordance with the present invention.

Referring to FIG. 11, during a period T1, the first switch Q1 is turned on to form a current path from the source capacitor Cs to the panel capacitor via the first switch Q1 and the second inductor L2. Once the current path is formed, the voltage Vs1/2 charged in the source capacitor Cs is supplied to the panel capacitor PANEL. At this time, a voltage of Vs1, substantially twice the voltage of the source capacitor Cs, is supplied to the first inductor L1 and the panel capacitor. In doing so, since the second inductor L2 and panel capacitor PANEL construct a serial resonant circuit, a voltage of Vs1, substantially twice the voltage of the source capacitor Cs, is supplied to the panel capacitor PANEL.

During a period T2, the third switch Q3 is turned on to supply a first voltage to the panel capacitor, and thus the voltage of the panel capacitor is maintained at the first voltage V1. Meanwhile, the first voltage V1 is set to be lower than a conventional sustain voltage Vs, so that a sum of wall charges formed at the panel capacitor with the first voltage V1 fails to go beyond a discharge start voltage. Thus, during the period T2, a sustain discharge is not generated at the panel capacitor.

During a period T3, the fifth switch Q5 is turned on. If the fifth switch is turned on, then a voltage of the first capacitor C1 is applied, via the fifth switch Q5 and the first inductor L1, to the panel capacitor. At this time, since the first inductor L1 forms a serial resonant circuit along with the panel capacitor, a sine wave rising and falling to a second voltage V2 from the first voltage V1 is supplied to the panel capacitor. Here, the panel capacitor supplied with a voltage higher than the first voltage by the sine wave has a voltage value higher than the discharge start voltage, and accordingly a sustain discharge is generated at the panel capacitor.

During a period T4, the fifth switch Q5 is turned off. Once the fifth switch Q5 is turned off, a supply of a sine wave is stopped, and the panel capacitor maintains the first voltage through the third switch Q3.

During a period 5, the third switch Q3 is turned off, and the second switch Q2 and the sixth switch Q6 are turned on. Once the second switch Q2 and the sixth switch Q6 are turned on, a current path is formed from the panel capacitor to the source capacitor Cs via the second inductor L2 and the second switch Q2 and the sixth switch Q6, for recovering the voltage charged in the panel capacitor to the source capacitor Cs. At this time, a voltage of Vs1/2 is charged at the source capacitor Cs.

During a period T6, the fourth switch Q4 is turned on, thereby dropping the voltage of the panel capacitor to the ground voltage. During a period T7, the second switch Q2 is turned off, thereby maintaining the ground voltage. Substantially, the pulses supplied to the scan and sustain electrodes can be provided by repeating the periods T1 to T7 periodically.

The third embodiment of the present invention constructed and operated as described above is configured such that the sine wave appears on a square waveform for at least a ½ period or longer.

In this case, like FIG. 8, it is possible to apply a sine wave during one period or more so that two or more peak portions having the highest potential can appear on a square wave.

If two or more peak portions of the sine wave are applied, two discharges occur during a single sustain pulse period. In this case, two or more peak portions have to be applied during one sustain pulse period. Thus, the period of the sine wave can be shortened and then applied in order to apply two or more peak portions for a short period of time.

In this manner, the discharge efficiency is improved as compared to the case where one discharge occurs during one sustain pulse in the conventional art.

Figure 12:
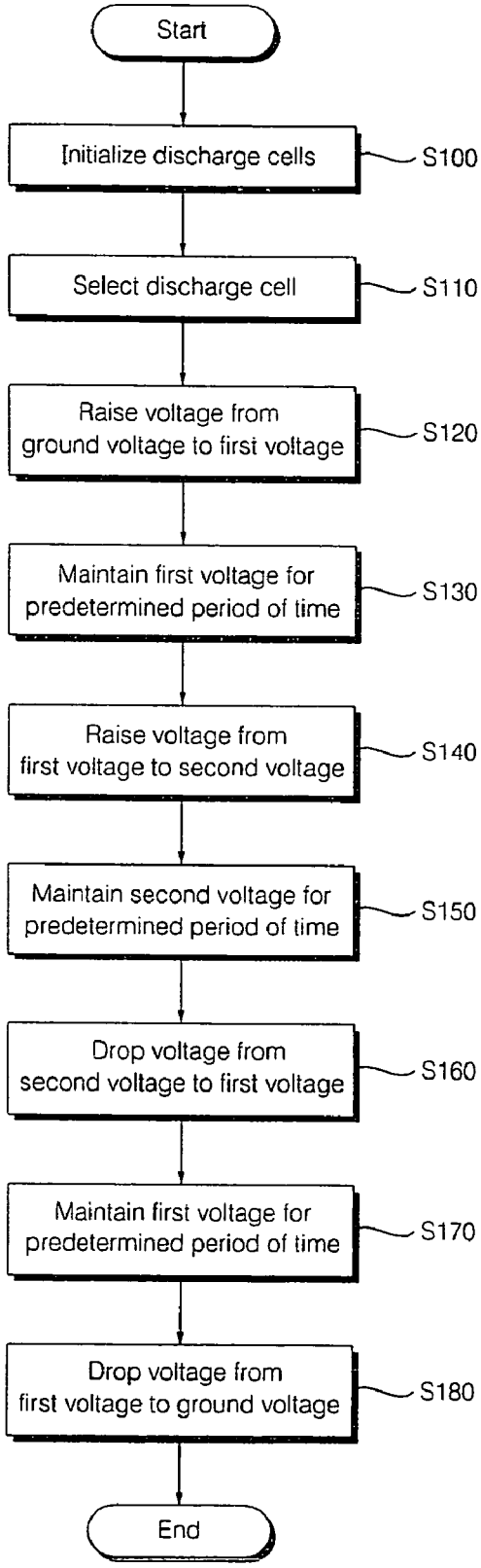
FIG. 12 is a sequence diagram illustrating a method of driving a plasma display apparatus in accordance with the present invention.

FIG. 12 is a sequence diagram illustrating a method of driving a plasma display apparatus in accordance with the present invention.

Referring to the sequence diagram of FIG. 12 and the waveform of FIG. 3, in the method of driving a plasma display apparatus, a driving waveform includes a plurality of subfields for representing one frame, each of the subfields including a reset period, an address period and a sustain period.

During the reset period, the plasma display apparatus initializes discharge cells. That is, the discharge cells are initialized so that wall charges of all the discharge cells can be distributed in the same pattern (S100).

During the address period, a discharge cell for outputting data is selected from the plurality of discharge cells (S110).

Once the discharge cell in which a discharge is to be generated is selected as above, a sustain pulse is repeatedly applied to the corresponding discharge cell during the sustain period.

A change in voltage per sustain pulse is as follows.

First, at the start of one sustain pulse, the voltage is raised from the ground voltage to a first voltage (S120). In this case, the voltage is gradually raised so that the waveform has a predetermined curvature during the rise from the first voltage to a second voltage. Next, the first voltage is substantially constant for a predetermined period of time (S130). Afterwards, the voltage is raised from the first voltage to the second voltage (S140). Once the voltage increases up to the second voltage, the second voltage is substantially constant for a predetermined period of time (S150).

Next, after the second voltage is kept constant for a predetermined period of time, the voltage is decreased from the second voltage to the first voltage again (S160). In this case, also, the voltage is gradually dropped so that the waveform has a predetermined curvature during the drop from the second voltage to the first voltage. When the voltage decreases to the first voltage, the first voltage is substantially constant for a predetermined period of time (S170), and the voltage is dropped from the first voltage to the ground voltage (S180).

Here, the first voltage is less than a discharge start voltage, and the second voltage is more than the discharge start voltage.

Hence, in the interval in which the first voltage is applied and maintained, no sustain discharge occurs, but in the interval in which the voltage rises from the first voltage to the second voltage, a discharge occurs. Afterwards, while the second voltage is reached and maintained, one more sustain discharge occurs.

Subsequently, since at least two discharges can occur per a single sustain pulse, the discharge efficiency is improved.

The plasma display apparatus and method of driving the same in accordance with the present invention constructed as described above can generate at least two discharges per a single sustain pulse by applying a sustain pulse rising and falling in two stages during one sustain period, and can improve discharge efficiency and luminance by lengthening a light emission time by maintaining the light generated by a discharge for a predetermined time.

Although the plasma display apparatus and method of driving the same in accordance with the present invention have been described with reference to the illustrated drawings, the invention is not limited to the embodiments and drawings disclosed in the specification and various modifications and variations may be made within the spirit and scope of the invention.

What is claimed is:

1. A plasma display apparatus, comprising:

a first electrode formed on an upper substrate; and a first electrode driver for applying a driving signal to the first electrode, wherein the first electrode driver applies a sustain pulse during a sustain period, the sustain pulse comprising:

an interval in which the sustain pulse rises from a ground voltage to a first voltage;

an interval in which the first voltage is substantially constant for a predetermined period of time;

an interval in which the sustain pulse rises from the first voltage to a second voltage;

an interval in which the second voltage is substantially constant for a predetermined period of time;

an interval in which the sustain pulse falls from the second voltage to the first voltage after the interval in which the second voltage is substantially constant; and an interval in which the sustain voltage falls from the first voltage to the ground voltage, wherein in the interval in which the sustain pulse falls from the second voltage to the first voltage, the voltage decreases by resonation with an inductor provided at the first electrode driver and a panel capacitor.

2. The plasma display apparatus as claimed in claim 1, wherein the first electrode is a scan electrode or sustain electrode.

3. The plasma display apparatus as claimed in claim 1, wherein in the interval in which the sustain pulse rises from the first voltage to the second voltage, the voltage gradually increases with a predetermined curvature.

4. The plasma display apparatus as claimed in claim 1, wherein in the interval in which the sustain pulse rises from the first voltage to the second voltage, the voltage increases by resonation with the inductor provided at the first electrode driver and the panel capacitor.

5. The plasma display apparatus as claimed in claim 1, wherein the first voltage is less than a discharge start voltage.

6. The plasma display apparatus as claimed in claim 1, wherein the second voltage is higher than a discharge start voltage.

7. The plasma display apparatus as claimed in claim 1, wherein in the interval in which the sustain pulse falls from the second voltage to the first voltage, the voltage gradually decreases with a predetermined curvature.

8. The plasma display apparatus as claimed in claim 7, wherein the sustain pulse further comprises an interval in which the first voltage is substantially constant for a predetermined time before falling from the first voltage to the ground voltage after the sustain pulse falls from the second voltage to the first voltage.

9. A method of driving a plasma display apparatus that is driven by a driving signal having a reset period, an address period and a sustain period, wherein a sustain pulse is applied during the sustain period, the sustain pulse comprising:

an interval in which the sustain pulse rises from a ground voltage to a first voltage;

an interval in which the first voltage is substantially constant for a predetermined period of time;

an interval in which the sustain pulse rises from the first voltage to a second voltage;

an interval in which the second voltage is substantially constant for a predetermined period of time;

an interval in which the sustain pulse falls from the second voltage to the first voltage after the interval in which the second voltage is substantially constant; and an interval in which the sustain voltage falls from the first voltage to the ground voltage, wherein in the interval in which the sustain pulse falls from the second voltage to the first voltage, the voltage decreases by resonation with an inductor provided at a first electrode driver and a panel capacitor.

10. The method as claimed in claim 9, wherein in the interval in which the sustain pulse rises from the first voltage to the second voltage, the voltage gradually increases with a predetermined curvature.

11. The method as claimed in claim 9, wherein the first voltage is less than a discharge start voltage.

12. The method as claimed in claim 9, wherein the second voltage is higher than a discharge start voltage.

13. The method as claimed in claim 9, wherein in the interval in which the sustain pulse falls from the second voltage to the first voltage, the voltage gradually decreases with a predetermined curvature.

14. The method as claimed in claim 9, wherein the sustain pulse further comprises an interval in which the first voltage is substantially constant for a predetermined time before falling from the first voltage to the ground voltage after the sustain pulse falls from the second voltage to the first voltage.

* * * * *